United States Patent [19]

Tilly et al.

[11] 4,424,750

[45] Jan. 10, 1984

[54] SINGLE WHEELSET RAILWAY TRUCK SIDEFRAME

[75] Inventors: Lynn K. Tilly, Allison Park, Pa.; Ernest C. Bergquist, Homewood, Ill.

[73] Assignee: AMSTED Industries Incorporated, Chicago, Ill.

[21] Appl. No.: 431,217

[22] Filed: Sep. 30, 1982

[51] Int. Cl.[3] ..... B61D 3/00; B61D 5/24; B61D 5/44

[52] U.S. Cl. ..... 105/206 R; 105/165; 105/182 R; 105/199 S; 267/4

[58] Field of Search ..... 105/165, 182 R, 199 S, 105/206 A, 206 R, 224 R; 267/4

[56] References Cited

U.S. PATENT DOCUMENTS

| | | | |
|---|---|---|---|
| 2,051,649 | 8/1936 | Delkers | 105/206 R X |
| 2,135,728 | 11/1938 | Delkers | 105/224 R X |
| 2,393,046 | 1/1946 | Keller | 105/182 R X |
| 2,907,283 | 10/1959 | Markestein et al. | 105/182 R X |
| 4,339,996 | 7/1982 | Brodeur et al. | 105/199 S X |

*Primary Examiner*—Robert B. Reeves
*Assistant Examiner*—Howard Beltran
*Attorney, Agent, or Firm*—Edward J. Brosius; Fred P. Kostka

[57] ABSTRACT

A side frame for a single axle railway truck is provided. The side frame has top and bottom and spaced side walls. The side frame has a generally hollow cross section, with an upper middle portion, downwardly sloped intermediate portion and lower outer portions. The top and bottom walls have decreasing thickness inwardly from the end of the outer portions.

2 Claims, 4 Drawing Figures

SINGLE WHEELSET RAILWAY TRUCK SIDEFRAME

BACKGROUND OF THE INVENTION

The present invention relates to railway vehicle trucks and more particularly to the side frame in a truck having a single wheelset.

Traditionally, a truck for use with a railway vehicle has at least a pair of spaced wheelsets and is commonly called a 4-wheel truck. Each wheelset comprises two wheels joined to a free axle wherein the wheels and respective axle rotate as a unit. Such trucks were developed to support considerable loads and today are available with railway cars having rated capacities of 100 tons or greater.

When the railway vehicle is not required to carry such heavy loads, for example in passenger service or piggy-back type service of automotive trailers or containers, then the load carrying capacity of the truck may be reduced substantially.

One suggested railway vehicle truck particularly adapted for lighter loads includes a single wheelset. The wheelset has its axle ends rotatively journaled in bearings. The bearings in turn operatively connect through an adapter to a centrally located pedestal jaw integrally formed as part of each of a pair of spaced longitudinally positioned side frames.

At each side frame end is an inwardly projecting bracket which in turn pivotally supports an upper end of a swing hanger. Positioned laterally between the front and rear swing hanger pairs is a swing hanger stabilizer beam assembly. Each assembly has a pair of end caps which pivotally connect respectively with a lower end of each swing hanger pair.

Because the upper side frame bracket-swing hanger pivot connections are located apart at a lesser distance than the lower swing hanger stabilizer beam assembly end cap-swing hanger pivot connections, the swing hanger stabilizer beam assembly is self leveling. Each swing hanger stabilizer beam assembly end cap has a pair of caps which contain the lower ends of a set of springs. Upper ends of the spring sets are operatively connected to a body of the railway vehicle and resiliently support such.

The railway truck as described above in theory provides certain advantages over the traditional 4-wheel truck. First, the mass of the truck is reduced. This lesser mass between the track and the car body reduces track wear and reduces the energy required to move the railway vehicle body associated with the truck. This mass can be further minimized by using components having an optimum strength-to-weight ratio.

SUMMARY OF THE INVENTION

According to the present invention there is provided an improved truck for a railway vehicle. The truck has a pair of spaced side frames with each side frame having an elongated hollow configuration. Within the side frame near each end thereof the top and bottom surface and the inner side surface are inwardly tapered from an initial thickness at the end surface to a lesser thickness inside the side frame. Further, the outer inboard and outboard walls of the side frame are of a lessened thickness than previous designs. The combination of such features provides a structurally sound side frame that exhibits such strength with a lessened overall weight. Further, as such side frames are cast in a foundry operation, such lessened wall thickness reduces the size and number of risers in the casting. This enhances foundry productivity and efficiency. Essentially the modifications to the ends of the side frame comprise the formation of a transverse rib to provide sectional torsional stability to the box structure side frame.

DESCRIPTION OF THE PREFERRED EMBODIMENT

Figure 1:
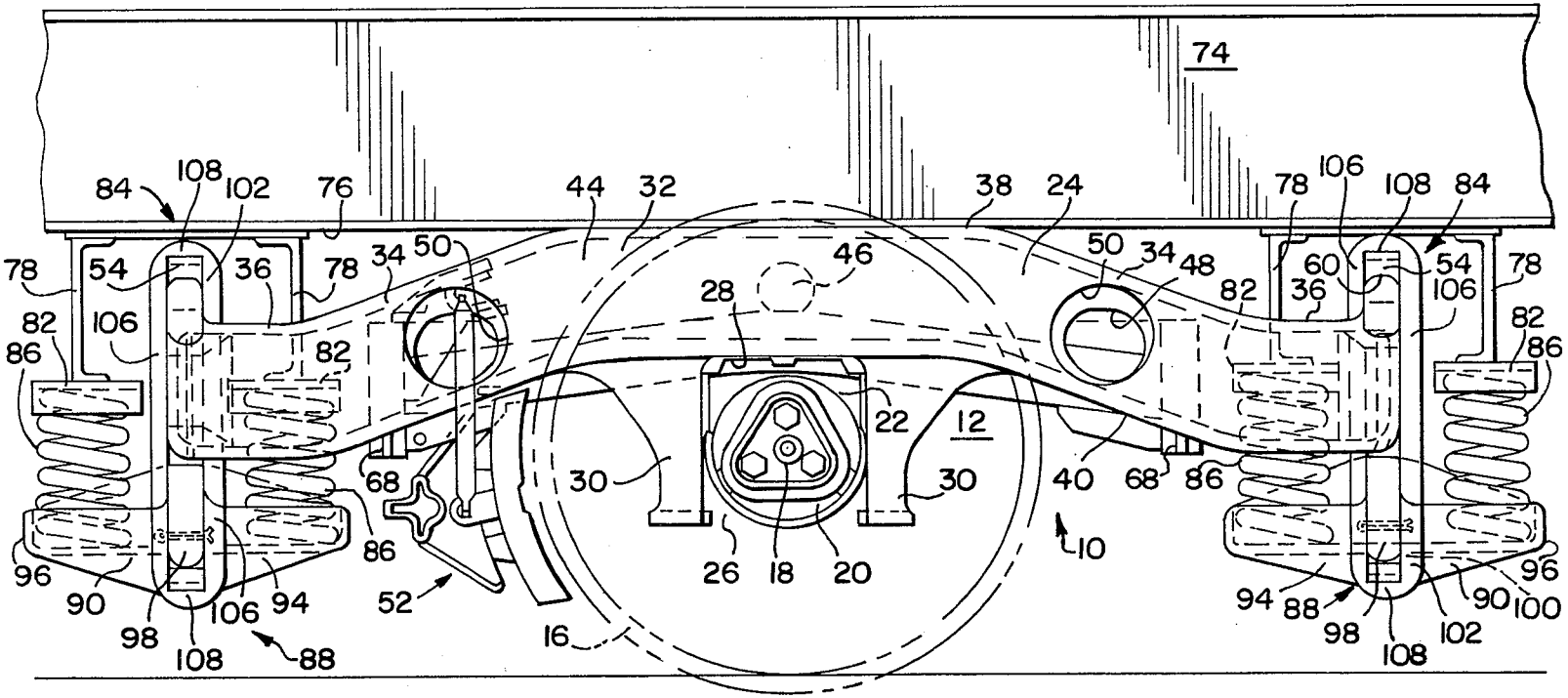
FIG. 1 is a side elevational view of a railway car truck made in accordance with the present invention.
Figure 2:
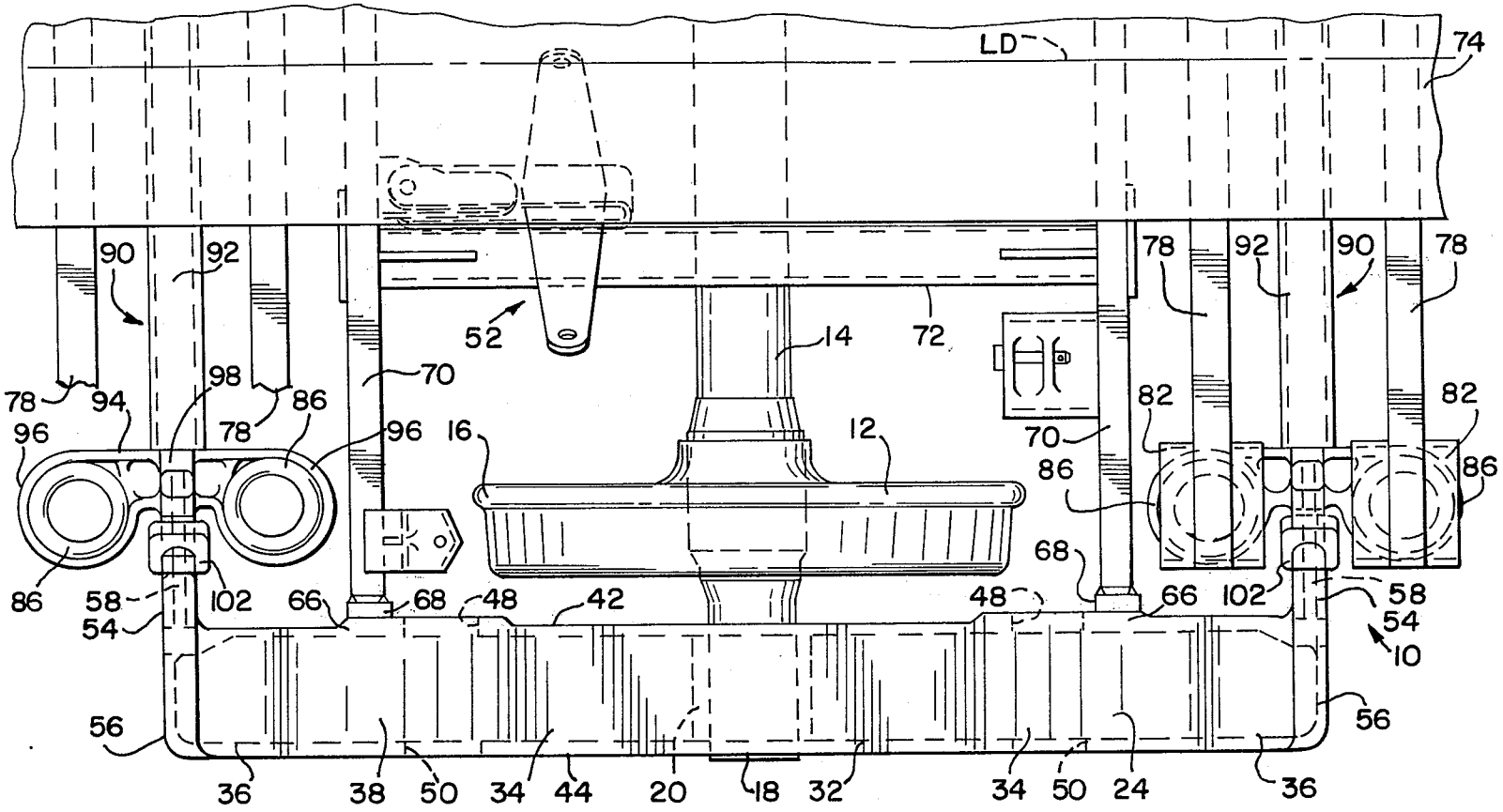
FIG. 2 is a partial plan view of the railway truck of the present invention with a selective upper portion of the truck cutaway.

A railway car truck embodying the present invention is shown generally in FIGS. 1 and 2 and is designated 10. Truck 10 includes a wheelset 12 comprising a free axle 14 with a pair of spaced wheelsets attached thereto. Only one such wheelset is shown in FIG. 2.

An axle end 18 of the wheelset 12 is journaled in a bearing 20 in a known manner. An adapter 22 operatively connects the axle end 18 and the bearing 20 to a side frame 24. The adapter 22 is positioned within a pedestal jaw 26 defined by a flat roof 28 and spaced end portion 30. The pedestal jaw roof 28 and end portion 30 are formed as an integral part of the side frame 24.

Figure 4:
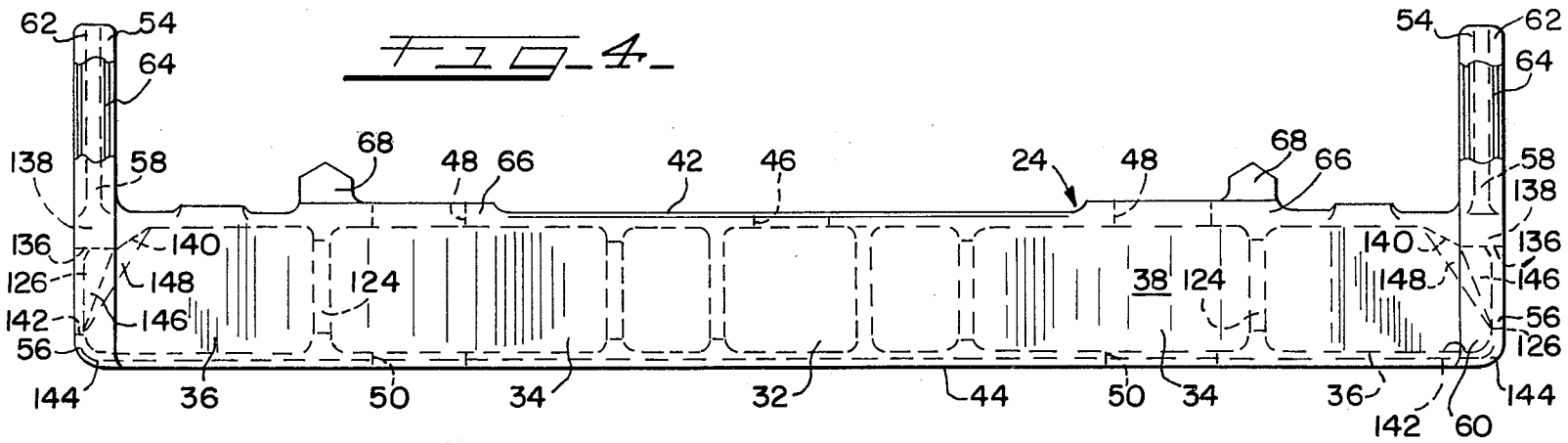
FIG. 4 is a top plan view of the side frame of the present invention as seen generally along the line 4—4 of FIG. 3.

As seen in FIGS. 1 and 4, the side frame 24 has a gull wing-like configuration defined by an upper middle portion 32 which is joined at each end by downwardly sloped intermediate portions 34. Ends of the sloped intermediate portions 34 in turn connect with lower outer portions 36. The side frame 24 has a generally hollow cross section configuration comprising top and bottom walls 38, 40 joined by spaced inner and outer side walls 42, 44. Centrally located in the inner side wall 42 is an opening 46. Also in each side wall 42, 44 and located in each side frame intermediate portion 34 are outer openings 48, 50 which have generally round configurations. The openings 48, 50 provide access to brake rigging shown generally and designated 52.

Figure 3:
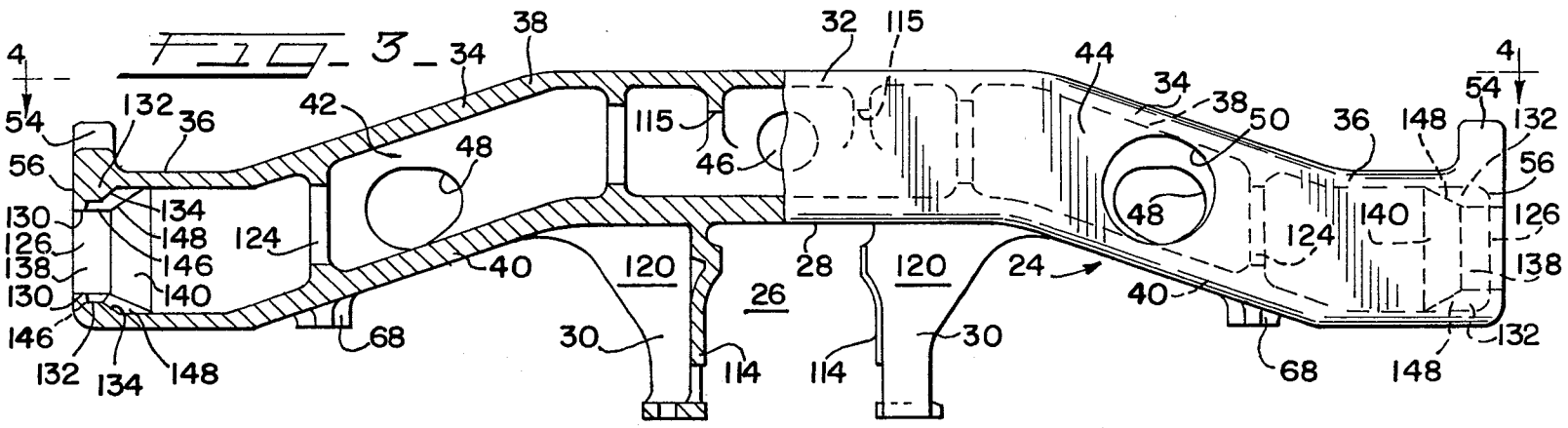
FIG. 3 is a side elevation view of the side frame of the present invention.

As best seen in FIGS. 3 and 4, projecting inwardly from an end of each side frame outer portion 36 is a bracket 54 having an offset configuration. The bracket 54 is formed as an integral part of an end wall 56 of the side frame 24 and includes a vertical reinforcing rib 58. The rib 58 joins a bottom surface 60 of the bracket 54 and the inner side wall 42 of the side frame 24. A top surface 62 of each bracket 54 is formed with a radiused groove 64.

On the inner sidewall 42 of the side frame 24 is a pair of spaced raised portions 66 which extend about each inner opening 48 and include a rectangular shaped boss 68. Attached to each boss 68 is an end of a transom cross bar 70, see FIG. 2. It should be understood that the cross bars 70 extend laterally across the truck 10 with an opposite end of each connecting with like boss formed on the other side frame (not shown). The cross bars 70 join the side frames into a rigid unit. To provide further stiffness, a pair of longitudinal bracing members connect the cross bars 70 with one such member 72 shown in FIG. 2.

A body of the railroad vehicle (not shown in detail) may include a longitudinal underframing support 74 shown in FIG. 1. Affixed to a bottom surface 76 of the support 74 are two pairs of laterally positioned channels 78. Attached at an outer end of each pair of channels 78 is a pair of upper spring cups 82 which contain upper ends of a set of coil springs 86.

Positioned laterally on each side of the wheelset 12 is a crosstie assembly 90. Each crosstie assembly 90 comprises a middle tubular portion 92 having its ends joined to spaced end caps 94. Each end cap 94 is formed with a pair of spring cups 96 which in turn loosely hold lower ends of the set of springs 86. Positioned between the spring cups 96 and attached thereto is a center block 98.

Each crosstie assembly 90 is operatively connected to the side frames by a pair of swing arms, and in FIGS. 1 and 2 for example, two of the four swing arms are shown and designated 102. Each swing arm 102 has an elongated loop-like configuration defined by a pair of straps 106 which are joined together by upper and lower cross pieces 108. Each cross piece 108 forms a seat for a bushing which interfaces between the side frame bracket radiused groove 64 and the crosstie assembly end cap radiused groove to form an upper and lower pivot connection 84, 88. These pivot connections 84, 88 allow the crosstie assemblies 90 to swing laterally to accommodate like movements of the body of the railroad vehicle. Note that the upper pivot connections 84 are inwardly offset from the lower pivot connections 88. This offset produces a self-leveling effect to dampen the swing action of the crosstie assemblies 90 transferred from like movements of the railroad vehicle body during travel thereof.

To best understand the construction of the side frame 24, it is suggested that FIGS. 3 and 4 be viewed concurrently with the written description below.

The top and bottom walls 38, 40 of the side frame middle upper portion are generally horizontal with the bottom wall 40 being proximately 60 percent thicker than the top wall i.e. 1 3/16 in. (3.0 cm) v., $\frac{3}{4}$ in. (1.9 cm) thick. This greater thickness provides the bottom wall 40 with the necessary flexible strength for transferring dynamic and static loads between the wheelset 12, the side frame 24 and the body of the railroad vehicle thereabove. Note that the bottom surface of this bottom wall portion serves as the roof 28 of the pedestal jaw 26. The end portions 30 of the pedestal jaw 26 are formed integrally with and extend downward from the side frame bottom wall 40.

The bottom wall 40 in the side frame sloped intermediate portion 34 also are made with an increased thickness of about $1\frac{1}{2}$ inches (2.86 cm) while the bottom wall 40 of each outer end portion 36 has a reduced thickness proximating $\frac{5}{8}$ in., (1.59 cm) for example. The top wall 38 of each sloped intermediate portion 34 is also made to an increased thickness of about $1\frac{1}{2}$ inches (2.86 cm) while the top wall 38 of each outer end portion 36 has a reduced thickness of, for example, $\frac{5}{8}$ in. (1.59 cm).

Each side frame end wall 56 has a square shaped opening 126 defined in part by a top and bottom lip 130, see FIG. 3. The top and bottom lips 130 join a top and bottom segment 132. The top and bottom segments 132 each have a tapered inner face 134 which merge with the top and bottom wall 38, 40 respectively. An inner vertical edge 136 of the end wall opening 126 in turn joins an inner side wall segment 138. The segment 138 has a tapered inner face 140 which merges with the side frame inner side wall 42. Inner side wall 138 tapers from about $1\frac{3}{4}$ in. (4.45 cm) to about $\frac{5}{8}$ in. (1.59 cm). An outer vertical edge 142 of the end wall opening 126 joins with a thinned vertical corner section 144 which in turn merges with the side frame outer side wall 44. Because the outer side wall 44 at the corner section 144 is thin while the top and bottom segments 132 and inner side wall segments 138 are substantially thicker, a pair of upper and lower triangular shaped surfaces 146, 148 are inwardly, and upwardly and downwardly formed.

During operation of the railroad vehicle which would include a set of the trucks 10 located one each at respective end of the vehicle, each truck 10 is subjected to dynamic and static forces. These forces are multidirectional in nature and produce shear, bending, tensile, compressive and torsional stresses in the various truck components.

One force which is substantially vertical in direction comprises a static component generated from a weight of the vehicle body and its related load. The other component of this vertical force is dynamic in nature and results from changes in the absolute and relative vertical location of the truck 10 and the vehicle body.

Also during travel of the railroad vehicle the railroad vehicle body bounces, rolls and pitches in response to track irregularities, changes in velocity and changes in direction, as it traverses both tangent and curved sections of track. Such movements are translated in part into a sideway swinging or lateral oscillating movement of the vehicle body. These movements and related dynamic forces are transferred by the springs 86 to the crosstie assemblies 90 which may swing as provided by the upper and lower pivot connections 84, 88 between the side frame brackets 54, the swing arms 102 and the crosstie assemblies 90 respectively. These related forces also increase and decrease the dynamic component of the vertical force depending on the relative position of the crosstie assemblies as they swing from side-to-side.

All of these forces as noted are transferred by the crosstie assemblies 90 to the side frames 24 by the swing arms 102. The side frames 24 in turn transfer such to the wheelset 12. Note the points at which these forces are transferred, i.e. lines of force, from the swing arms 102 to the side frames 24 are at the upper pivots 84. On the other, the effective point of transfer, i.e. line of force, between the side frame 24 and the wheelset 12 is the side frame pedestal jaw 26.

These lines of force are spaced apart longitudinally and laterally. The longitudinal spacing creates a force moment which produces bending stresses in the side frame 24. On the other hand, the lateral spacing creates a force moment which produces torsional or twisting stresses in the side frame 24. Note, however, that twisting of the side frame 24 is substantially limited to the lower outer end portions 36 because of the transom cross bars 70 resist any twisting of the sloped intermediate portions 34 and middle upper portion 32. Within the inner side wall 42 and top and bottom walls 38, 40 the twisting forces and bending forces are in the same direction and thus accumulate to produce high levels of stress. Within the side frame outer side wall 36 the stress is at a reduced level because the twisting forces tend to cancel the bending forces being in the opposite direction. The accumulative bending and twisting forces are particularly accommodated by the raised portions 66 in the inner side wall 42 which join with the thickened top and bottom wall.

What is claimed is:

1. A side frame for use in a single axle railway truck, said side frame comprising a top and a bottom wall joined by spaced inner and outer side walls to form a generally hollow cross section elongated structure, said side frame having an upper middle portion, two downwardly sloped intermediate portions and two lower outer portions, the thickness of the bottom wall being substantially greater than the thickness of the top wall in the upper middle portion, the thickness of the top wall being substantially the same as the thickness of the bottom wall in the two sloped intermediate portions and the thickness of the top wall being substantially the same as the thickness of the bottom wall in the two lower outer portions, such thickness being substantially less than the thickness of the top and bottom wall sloped intermediate portions.

2. The side frame of claim 1, wherein the bottom wall is about sixty percent thicker than the top wall in the upper middle portion.

* * * * *